US010483051B2

(12) United States Patent
Steinbauer

(10) Patent No.: US 10,483,051 B2
(45) Date of Patent: Nov. 19, 2019

(54) CONTACT SLIDE UNIT FOR A SWITCHING UNIT

(71) Applicant: SIEMENS AKTIENGESELLSCHAFT, München (DE)

(72) Inventor: Martin Steinbauer, Schmidmühlen (DE)

(73) Assignee: Siemens Aktiengesellschaft, München (DE)

( * ) Notice: Subject to any disclaimer, the term of this patent is extended or adjusted under 35 U.S.C. 154(b) by 145 days.

(21) Appl. No.: 15/556,550

(22) PCT Filed: Nov. 2, 2015

(86) PCT No.: PCT/EP2015/075426
§ 371 (c)(1),
(2) Date: Sep. 7, 2017

(87) PCT Pub. No.: WO2016/142007
PCT Pub. Date: Sep. 15, 2016

(65) Prior Publication Data

US 2018/0053605 A1 Feb. 22, 2018

(30) Foreign Application Priority Data

Mar. 11, 2015 (EP) ..... 15158551

(51) Int. Cl.
*H01H 3/00* (2006.01)
*H01H 1/20* (2006.01)
(Continued)

(52) U.S. Cl.
CPC ..... *H01H 1/20* (2013.01); *H01H 1/32* (2013.01); *H01H 1/50* (2013.01); *H01H 1/2008* (2013.01); *H01H 73/045* (2013.01)

(58) Field of Classification Search
CPC ..... H01H 15/04; H01H 15/10; H01H 11/00; H01H 11/20; H01H 11/2008; H01H 73/045
(Continued)

(56) References Cited

U.S. PATENT DOCUMENTS 4,258,237 A * 3/1981 Beck ..... H01H 11/00 200/11 J
4,742,188 A * 5/1988 Buehler ..... H01C 1/12 200/16 R
(Continued)

FOREIGN PATENT DOCUMENTS

CN 201199488 Y 2/2009
CN 202633106 U 12/2012
(Continued)

OTHER PUBLICATIONS

Chinese Office Action for Chinese Application No. 201580077592.X, dated Jul. 27, 2018, with English Translation.
(Continued)

*Primary Examiner* — Shawki S Ismail
*Assistant Examiner* — Lisa N Homza
(74) *Attorney, Agent, or Firm* — Lempia Summerfield Katz LLC

(57) ABSTRACT

The disclosure relates to a contact slide unit for a switching unit, including a contact slide inside which a movable contact piece is guided, wherein the contact piece is biased from one side by a contact load spring. The disclosure also relates to a method for assembling the contact slide unit. The disclosure is characterized in that the movable contact piece is mounted in a winding interstice between two windings of the contact load spring.

18 Claims, 2 Drawing Sheets

(51) Int. Cl.
*H01H 1/32* (2006.01)
*H01H 1/50* (2006.01)
*H01H 73/04* (2006.01)

(58) Field of Classification Search
USPC ..... 335/195
See application file for complete search history.

(56) References Cited

U.S. PATENT DOCUMENTS 6,060,670 A * 5/2000 Oikawa ..... H01H 11/06 200/16 R
2002/0118319 A1* 8/2002 Ootsuta ..... G02F 1/1333 349/59
2007/0249198 A1* 10/2007 Nakase ..... H01H 13/52 439/157
2007/0272525 A1* 11/2007 Suzuki ..... H01H 81/02 200/16 R
2009/0205940 A1* 8/2009 Altmann ..... H01H 15/107 200/327
2009/0302990 A1* 12/2009 Neilly ..... H01H 37/043 337/312
2012/0325636 A1* 12/2012 Nose ..... H01H 13/56 200/5 B
2013/0008768 A1* 1/2013 Nose ..... H01H 1/18 200/535
2014/0110231 A1* 4/2014 Kibiti ..... H01H 15/04 200/293
2014/0224629 A1* 8/2014 Rosch ..... H01H 1/20 200/329
2016/0203926 A1* 7/2016 Steinbauer ..... H01H 9/346 218/154
2017/0032918 A1* 2/2017 Steinbauer ..... H01H 1/50
2017/0047177 A1* 2/2017 Steinbauer ..... H01H 1/20

FOREIGN PATENT DOCUMENTS

CN 203983188 U 12/2014
DE 10061394 A1 6/2002
EP 1970933 A1 9/2008
GB 2371409 A 7/2002
SU 955244 A1 8/1982
WO WO2013139385 A1 9/2013

OTHER PUBLICATIONS

Database WPI ; Week 198327; Thomson Scientific; London GB; AN 1983-705161, XP002744545; SU 955 244 AI (EVIRGZD A VA); 1982. p. 1-1.
European Search Report for European Application No. 15158551. 0-1808, dated Oct. 7, 2015.
PCT International Search Report for corresponding PCT/EP2015/075426, dated Dec. 3, 2015.
Chinese Office Action for Chinese Application No. 201580077592X dated Jan. 14, 2019, with English translation.

* cited by examiner

CONTACT SLIDE UNIT FOR A SWITCHING UNIT

The present patent document is a § 371 nationalization of PCT Application Serial Number PCT/EP2015/075426, filed Nov. 2, 2015, designating the United States, which is hereby incorporated by reference, and this patent document also claims the benefit of EP 15158551.0, filed Mar. 11, 2015, which is also hereby incorporated by reference.

TECHNICAL FIELD

The disclosure relates to a contact slide unit for a switching unit, wherein the contact slide unit has a contact slide with a moving contact piece guided therein, one side of which the moving contact piece is acted on by a contact load spring.

BACKGROUND

Switching units, (e.g., circuit breakers), are used inter alia for safe disconnection in the event of a short circuit and thus protect consumers and installations. Furthermore, electrical or mechanical switching units are suitable for the operationally dependent, manual switching of consumers and for the safe isolation of an installation from the electrical grid in the event of maintenance work or changes to the installation. Electrical switching units may be operated electromagnetically.

In other words, such switching units are electrical switching devices, which are high quality in technical terms with integrated protection for motors, lines, transformers, and generators. They are used at service facilities with a relatively low switching frequency. In addition to short-circuit protection, such switching units are also suitable for overload protection.

In the event of a short circuit, an electrical switching unit disconnects an electrical installation safely. Thus, this electrical switching unit provides safety protection from overload. Any conductor through which current is flowing is heated to a greater or lesser extent. The heating is in this case dependent on the ratio of the current intensity to the conductor cross section, known as the current density. The current density should not become too great because otherwise the conductor insulation may be scorched by excessive heating and possibly a fire may be triggered.

Circuit breakers have two tripping mechanisms, which act independently of one another for overload and short-circuit protection. Both releases are connected in series. In the event of a short circuit, an electromagnetic release, which acts virtually without any delay in time, performs the function of protection. In the event of a short circuit, the electromagnetic release unlatches a switching mechanism of the circuit breaker without any delay. A switching armature isolates the switching piece before the short-circuit current may reach its maximum value.

In circuit breakers having a high switching capacity ($I_{CU}$ up to 100 kA at a rated current of $I_N$=100 A), high short circuits occur, with the result that in turn large magnetic forces arise between the moving switching piece and the fixed switching piece. These are, for the one part, current-loop forces between the fixed switching pieces and the moving switching pieces and, for the other part, the much greater current constriction forces between the silver contacts. These two forces have the effect that, in the event of a short circuit, the moving switching piece is thrown suddenly counter to the resulting spring force thereof and strikes the impact domes in the lower part.

Furthermore, the abovementioned current constriction forces between the silver contacts do not act centrally in the middle of the contacts but decentrally further toward the periphery of the contacts. In addition to the opening force in the direction of the impact domes in the lower part, the moving switching piece therefore experiences a torque, which may result in rotation of the moving switching piece about the longitudinal axis. The striking of the impact domes, too, may have the effect, given an unfavorable position of the moving switching piece, that an undesired torque is again initiated.

Under extreme load it is occasionally possible for the moving switching piece to exploit its design-determined degrees of freedom, and, as a result of the initiated torques, for it either to become wedged in the contact slide or to rotate so far that regular contacting between the contacts of the moving switching piece and the fixed switching piece is no longer possible. In any case, reliable operation of the circuit breaker is no longer provided.

Known contact slides of these switching units frequently have two guide systems, namely an internal guide system and an external guide system. The external guide system is used when the switching operation, (e.g., the switch-on or switch-off operation), takes place via a switching mechanism of the switching unit. In this case, no bridge rotator occurs.

The internal guide system is used in the event of a short circuit when the switching operation is performed via a switching armature, (e.g., a plunger), of the switching unit. In other words, in the event of disconnection on account of a short circuit, the moving switching piece runs ahead of the contact slide along the internal guide system, rebounds at impact faces in what is referred to as the lower part of the switching unit and flies back along the internal guide system again. In this case, the moving switching piece flies in the opposite direction to the switching armature or the plunger of the switching unit. In this case, it is possible for the moving switching piece and the plunger to meet one another outside their center lines, and this may lead to rotation of the moving switching piece about its longitudinal axis.

If the moving switching piece remains in the rotated state, when the switching unit is next switched on, the contacts, (e.g., silver contacts of the moving switching piece and the fixed contacts of the switching unit), no longer meet one another, with the result that failure phenomena occur. In other words, a switching piece that remains in a rotated position is disadvantageous because the switching unit is then no longer usable. A non-functioning switching piece and a non-functioning switching unit are disadvantageous for the electrical consumers and the installation in which the switching unit is installed.

SUMMARY AND DESCRIPTION

Accordingly, the object of the present disclosure is to create a contact slide unit for a switching unit, which is configured such that bridge rotators of the switching piece are avoided, and to specify a method for assembling this contact slide unit.

The scope of the present disclosure is defined solely by the appended claims and is not affected to any degree by the statements within this summary. The present embodiments may obviate one or more of the drawbacks or limitations in the related art.

This object is achieved by a contact slide unit, which has a contact slide with a moving contact piece guided therein, one side of which contact piece is acted on by a contact load spring. In this case, the moving contact piece is mounted in a turn gap between two turns of the contact load spring.

The contact load spring may have an enlarged turn gap, in which the moving contact piece is mounted. As a result, the moving contact piece is mounted in the contact load spring in a form-fitting manner. In conjunction with the guide faces integrated in the contact slide, the applied turns of the contact load spring above and below the moving contact piece provide protection against rotations.

A further advantage of this concept is that it is not necessary to deviate from the original assembly process of the switching unit, in particular of the circuit breaker. The bridge only has to be inserted into the contact load spring before it is fitted with the contact slide. The modifications include a minor modification to the contact slide, correction of the stamped bridge geometry, and adjustment of the contact load spring geometry.

If the bridge is thrown downward by the current constriction forces and current-loop forces, the bridge is now held securely in position by way of its form-fitting position in the contact load spring, even when a torque acts on the bridge as a result of eccentric force introduction. Thus, tipping or tilting of the bridge in the contact slide is no longer possible.

In a particularly advantageous configuration, provision may be made for the turns of the contact load spring above the moving contact piece to be guided by a contour in the contact slide. The guides that are integrated into the contact slide serve to receive the turns of the contact load spring, which are arranged above the moving switching piece, that is to say on the side of the contact pads. Rotation protection is achieved by way of the form-fitting mounting of the moving contact piece in the contact load spring and by way of the contour, which engages with the turns of the contact load spring above the moving contact piece.

In one development of this concept, the contour in the contact slide is arranged in a conically tapering manner. The conical tapering of the contour thus provides that the turns above the moving contact piece of the contact load spring are received and guided securely.

In a further specific development of the concept, provision may be made for the turns of the contact load spring above the moving contact piece to be formed with a narrowing diameter. In this way, the turns of the contact load spring above the moving contact piece, which turns taper with a narrowing diameter, enclose the, e.g., conically tapering guide of the contact slide with some play.

In one configuration, one technical development of the concept may include a spacer being formed in the contact load spring between the last turn on the bottom side of the moving contact piece and the first turn on the top side of the moving contact piece. The spacer allows a somewhat enlarged turn gap to be formed in the contact load spring, with the result that the moving switching piece may be positioned in a simple way between the last turn on the bottom side of the moving contact piece and the first turn on the top side of the moving contact piece.

In a further specific development of this concept, provision may be made for the spacer to be level with the longitudinal edge of the moving contact piece. Forming the spacer to be level with the longitudinal edge of the moving contact piece allows the moving contact piece to be inserted easily into the contact spring and leads to the moving contact piece being mounted in a virtually stress-free manner between the last turn on the bottom side and the first turn on the top side.

In a specific configuration, the moving contact piece may have opposing projections. The projections were previously embodied to be semi-concentric and in the present disclosure are designed in the form of a quarter-concentric projection. In this way, the spacer may be positioned in the recess obtained as a result on the moving contact piece.

Provision may also be made for the contact slide to be used in a circuit breaker.

The object of the present disclosure is also achieved by a method for assembling a contact slide unit for a switching unit, having a contact slide with a moving contact piece guided therein, one side of which the contact piece is acted on by a contact load spring, including inserting the moving contact piece into a turn gap in the contact load spring; and fitting the structural unit including the current moving contact piece with the contact load spring in the contact slide.

The contact slide unit for a switching unit has a contact slide with a moving contact piece guided therein. The contact slide may be U-shaped with a central region, which has four side edges, a top side and a bottom side, and two lateral guides arranged opposite one another. The lateral guides lead into the central region and may have, at the end regions opposite to the central region, small feet, which serve as a support surface for the moving contact piece. A conically tapering contour may be arranged on the inner side of the central region of the contact slide, the contour proceeding from the top side in the direction of the moving contact piece.

The top side of the moving contact piece has a contact pad on each side next to the contact slide. The bottom side of the moving contact piece is mounted on a contact load spring. The last turn of the contact load spring below the moving contact piece transitions into a spacer, which may be level with the moving contact piece. The spacer transitions into the first turn of the contact load spring on the top side of the moving contact piece. As a result, the moving contact piece is mounted or clamped in a turn gap in the contact load spring. The turns above the moving contact piece may be formed with a narrowing diameter. The conically formed contour, for example, engages with the turns above the moving contact piece with the result that the turns are fixed and guided.

The contact slide unit is characterized in that the moving contact piece assumes a form-fitting position in the contact load spring and is securely held in the horizontal position, even after switching processes. Even in the case of eccentric introduction of the current constriction forces and current-loop forces, which act on the moving contact piece in the event of a short circuit and throw it in the lower part counter to the impact, the moving contact piece is effectively guided by the contact load spring. Tipping or even tilting of the moving contact piece is therefore no longer possible and a secure contact connection between the fixed switching piece and the moving contact piece is provided, even after a short circuit.

BRIEF DESCRIPTION OF THE DRAWINGS

Further advantages and embodiments of the disclosure are explained in more detail in the following text with reference to an exemplary embodiment and with reference to the drawing, in which, schematically.

DETAILED DESCRIPTION

Figure 1:
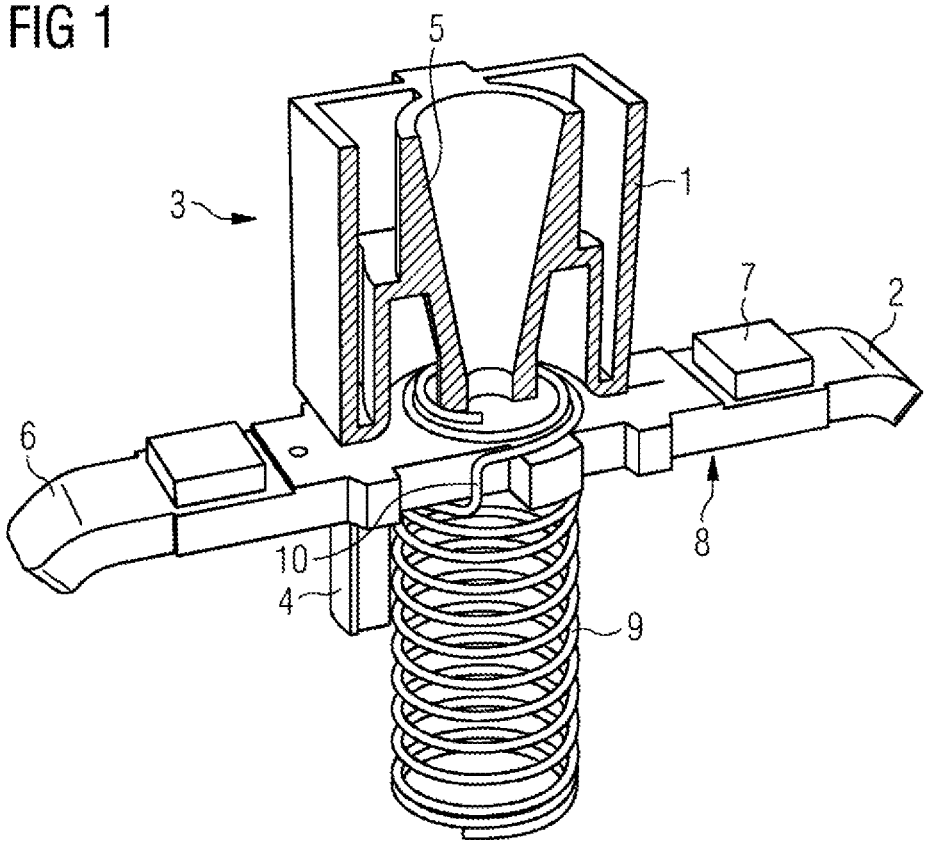
FIG. 1 depicts a perspective sectional illustration of a contact slide unit with a contact slide and a moving switching piece, as well as a contact load spring, according to an embodiment.

FIG. 1 depicts a contact slide unit with a contact slide 1 and a moving contact piece 2 guided therein. The contact slide 1 may be U-shaped with a central region 3, which has four side edges, a top side, and a bottom side, and two lateral guides 4 arranged opposite one another. The lateral guides 4 lead into the central region 3. A conically tapering contour 5 may be arranged on the inner side of the central region 3 of the contact slide 1, the contour proceeding from the top side in the direction of the moving contact piece 2.

The top side 6 of the moving contact piece 2 has a contact pad 7 on each side next to the contact slide 1. The bottom side 8 of the moving contact piece 2 is mounted on a contact load spring 9. The last turn of the contact load spring 9 below the moving contact piece 2 transitions into a spacer 10, which may be level with the moving contact piece 2. The spacer 10 transitions into the first turn of the contact load spring 9 on the top side 6 of the moving contact piece 2. Accordingly, the moving contact piece 2 is mounted or clamped in a turn gap of the contact load spring 9. The turns above the moving contact piece 2 may be formed with a narrowing diameter. The conically formed contour 5, for example, engages with the turn above the moving contact piece 2 with the result that the turns are fixed and guided.

Figure 2:
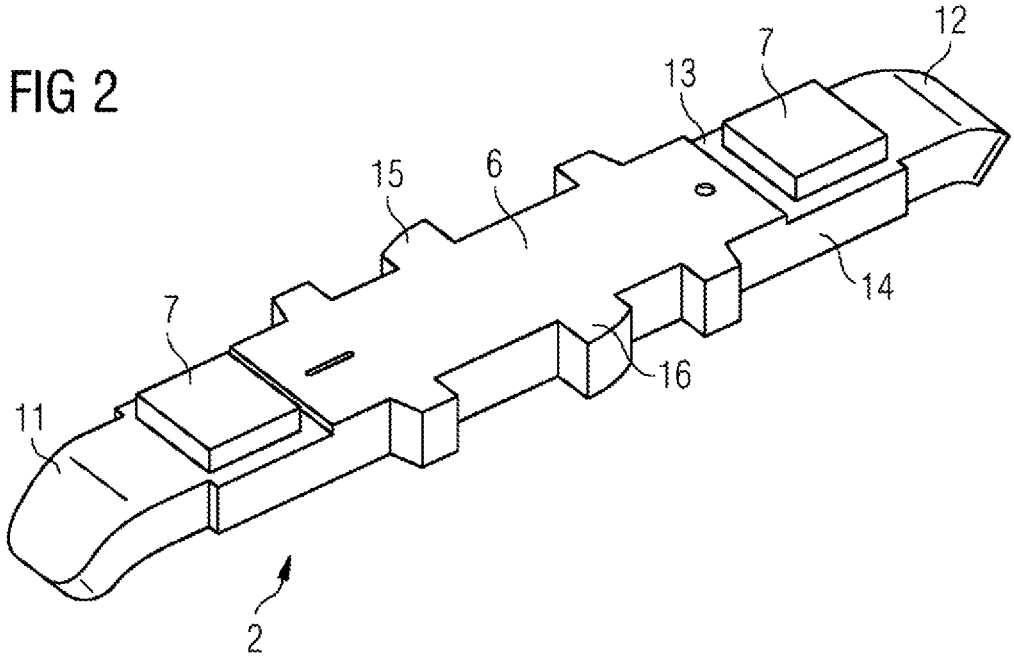
FIG. 2 depicts a perspective illustration of a moving contact piece, according to an embodiment.

FIG. 2 illustrates the geometry of the moving contact piece 2. The moving contact piece 2 may be web-shaped with a top side 6, on which a contact pad 7 is arranged in each of the two end regions 11, 12. The end regions 11, 12 of the moving contact piece 2 may be embodied to be easily bent downward. Projections 15, 16, which may be embodied to be quarter-concentric, are arranged on the longitudinal edges 13, 14 of the moving contact piece 2. The projections 15, 16 may be rotated by 180° with respect to one another, arranged on opposing longitudinal edges 13, 14.

Figure 3:
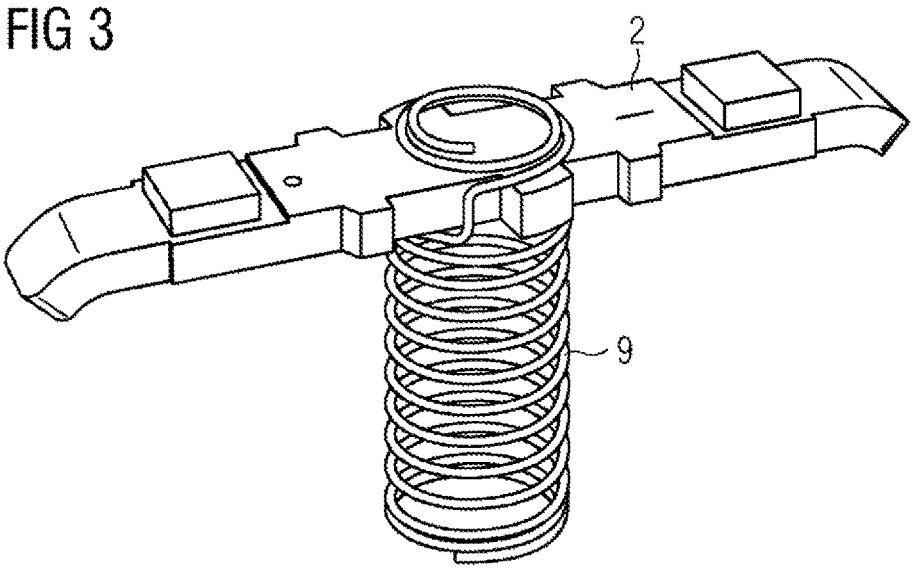
FIG. 3 depicts a perspective illustration of a structural unit including a moving contact piece and a contact load spring, according to an embodiment.

FIG. 3 illustrates a structural unit including a moving contact piece 2 and a contact load spring 9. This assembled structural unit including the moving contact piece 2 and the contact load spring 9 is used in the contact slide 1 as a complete component.

Figure 4:
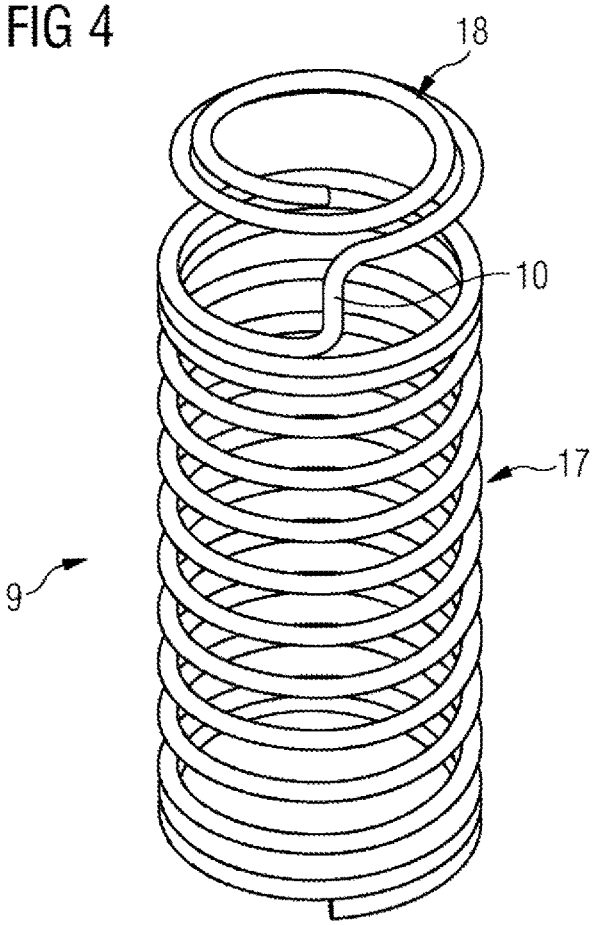
FIG. 4 depicts a perspective illustration of a contact load spring, according to an embodiment.

FIG. 4 illustrates the contact load spring 9. The contact load spring 9 includes two structural units. The first structural unit includes the lower part 17 of the contact load spring 9, which has numerous turns that may have the same diameter and thus forms a cylindrical body. The second structural unit of the contact load spring 9 includes the upper part 18. The upper part 18 has only a few turns, which may have a narrowing diameter. The lower part 17 is connected to the upper part 18 of the contact load spring 9 by a spacer 10. The spacer 10 makes the enlarged turn gap, for example, of the contact load spring 9 possible, with the result that the moving contact piece 2 may be inserted and clamped in the turn gap.

The contact slide unit is characterized in that a possibility has been found whereby the moving contact piece is positioned in a rotationally secure manner by way of a simple modification to the geometry of the contact load spring. No additional parts are required for this. The assembly processes may also proceed as previously.

Although the disclosure has been illustrated and described in detail by the exemplary embodiments, the disclosure is not restricted by the disclosed examples and the person skilled in the art may derive other variations from this without departing from the scope of protection of the disclosure. It is therefore intended that the foregoing description be regarded as illustrative rather than limiting, and that it be understood that all equivalents and/or combinations of embodiments are intended to be included in this description.

It is to be understood that the elements and features recited in the appended claims may be combined in different ways to produce new claims that likewise fall within the scope of the present disclosure. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

The invention claimed is:

1. A contact slide unit for a switching unit, the contact slide unit comprising:

a contact slide;

a moving contact piece guided within the contact slide, wherein the moving contact piece has a top side and a bottom side, and wherein the contact slide is positioned on the top side of the moving contact piece; and a contact load spring, wherein one side of the moving contact piece is acted on by the contact load spring, and wherein the moving contact piece is mounted in a turn gap between two turns of the contact load spring such that a first part of the contact load spring is positioned above the top side of the moving contact piece, a second part of the contact load spring is positioned below the bottom side of the moving contact piece, and the turn gap is positioned between the first part and the second part of the contact load spring.

2. The contact slide unit of claim 1, wherein turns of the contact load spring positioned above the top side of the moving contact piece are guided by a contour in the contact slide.

3. The contact slide unit of claim 2, wherein turns of the first part of the contact load spring positioned above the top side of the moving contact piece have a narrowing diameter extending in a direction away from the top side of the moving contact piece.

4. The contact slide unit of claim 2, further comprising:

a spacer positioned in the contact load spring between a last turn on the bottom side of the moving contact piece and a first turn on the top side of the moving contact piece.

5. The contact slide unit of claim 4, wherein the spacer is level with a longitudinal edge of the moving contact piece.

6. The contact slide unit of claim 2, wherein the contour in the contact slide is conically tapered.

7. The contact slide unit of claim 6, wherein turns of first part of the contact load spring positioned above the top side of the moving contact piece have a narrowing diameter extending in a direction away from the top side of the moving contact piece.

8. The contact slide unit of claim 7, further comprising:

a spacer positioned in the contact load spring between a last turn on the bottom side of the moving contact piece and a first turn on the top side of the moving contact piece.

9. The contact slide unit of claim 8, wherein the spacer is level with a longitudinal edge of the moving contact piece.

10. The contact slide unit of claim 9, wherein the moving contact piece has opposing projections.

11. The contact slide unit of claim 6, further comprising:

a spacer positioned in the contact load spring between a last turn on the bottom side of the moving contact piece and a first turn on the top side of the moving contact piece.

12. The contact slide unit of claim 11, wherein the spacer is level with a longitudinal edge of the moving contact piece.

13. The contact slide unit of claim 1, wherein turns of the first part of the contact load spring positioned above the top side of the moving contact piece have a narrowing diameter extending in a direction away from the top side of the moving contact piece.

14. The contact slide unit of claim 1, further comprising:

a spacer positioned in the contact load spring between a last turn on the bottom side of the moving contact piece and a first turn on the top side of the moving contact piece.

15. The contact slide unit of claim 14, wherein the spacer is level with a longitudinal edge of the moving contact piece.

16. The contact slide unit of claim 1, wherein the moving contact piece has opposing projections.

17. A circuit breaker comprising:

a contact slide unit, the contact slide unit having:

a contact slide;

a moving contact piece guided within the contact slide, wherein the moving contact piece has a top side and a bottom side, and wherein the contact slide is positioned on the top side of the moving contact piece, and a contact load spring, wherein one side of the moving contact piece is acted on by the contact load spring, and wherein the moving contact piece is mounted in a turn gap between two turns of the contact load spring such that a first part of the contact load spring is positioned above the top side of the moving contact piece, a second part of the contact load spring is positioned below the bottom side of the moving contact piece, and the turn gap is positioned between the first part and the second part of the contact load spring.

18. A method for assembling a contact slide unit for a switching unit, the method comprising:

providing a moving contact piece having a top side and a bottom side, inserting the moving contact piece into a turn gap in a contact load spring to provide a structural unit, wherein:

a first part of the contact load spring is positioned above the top side of the moving contact piece, a second part of the contact load spring is positioned below the bottom side of the moving contact piece, the turn gap is positioned between the first part and the second part of the contact load spring, and one side of the moving contact piece is acted on by the contact load spring; and fitting the structural unit in a contact slide, wherein the contact slide is positioned on the top side of the moving contact piece.

* * * * *